US011830407B2

(12) United States Patent
Fletcher et al.

(10) Patent No.: US 11,830,407 B2
(45) **Date of Patent: *Nov. 28, 2023**

(54) FAULT-TOLERANT LCD DISPLAY WITH DUAL TRANSISTOR PIXEL CELLS

(71) Applicant: L3 Technologies, Inc., New York, NY (US)

(72) Inventors: Mark W. Fletcher, Cumming, GA (US); Carlos Galleno, Alpharetta, GA (US)

(73) Assignee: L3 Technologies, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/894,707

(22) Filed: Feb. 12, 2018

(65) Prior Publication Data

US 2018/0233077 A1 Aug. 16, 2018

Related U.S. Application Data

(60) Provisional application No. 62/457,401, filed on Feb. 10, 2017.

(51) Int. Cl.
*G09G 3/20* (2006.01)
*G09G 3/36* (2006.01)

(52) U.S. Cl.
CPC ..... *G09G 3/2092* (2013.01); *G09G 3/3659* (2013.01); *G09G 3/3674* (2013.01);
(Continued)

(58) Field of Classification Search
None
See application file for complete search history.

(56) References Cited

U.S. PATENT DOCUMENTS 4,680,580 A 7/1987 Kawahara
5,012,228 A 4/1991 Masuda
(Continued)

FOREIGN PATENT DOCUMENTS

CN 1418044 5/2003
CN 101382714 3/2009
(Continued)

OTHER PUBLICATIONS

Invitation to Pay Additional Fees and, Where Applicable, Protest Fees dated May 4, 2018 by the European Patent Office / International Searching Authority for related international patent application PCT/US2018/017873.
(Continued)

*Primary Examiner* — Fred Tzeng
(74) *Attorney, Agent, or Firm* — DICKINSON WRIGHT PLLC

(57) ABSTRACT

A fault-tolerant display system includes a dual thin film transistor (TFT) panel with pixel cells having two independently-controlled switching transistors; as such, primary source and gate drivers are operative to drive the display with first TFT transistors, while secondary source and gate drivers are operative to drive the display with second TFT transistors. As the display incorporates an additional TFT within the pixel cell which is driven independently, reliability is increased even at the pixel level. In this way, individual pixels of the LCD panel are driven simultaneously and independently by two pairs of source drivers and gate drivers, such that if one of the driver pairs fails due to some fault, the other driver pair can continue to drive the LCD panel without loss of information despite the failure of the first driver pair.

4 Claims, 7 Drawing Sheets

(52) U.S. Cl.
CPC ... *G09G 3/3685* (2013.01); *G09G 2300/0814* (2013.01); *G09G 2330/08* (2013.01); *G09G 2380/12* (2013.01)

(56) References Cited

U.S. PATENT DOCUMENTS

| | | | | | |
|---|---|---|---|---|---|
| 5,436,635 | A * | 7/1995 | Takahara | H04N 9/3105 | 345/98 |
| 10,339,882 | B2 * | 7/2019 | Fletcher | G09G 3/3648 | |
| 2002/0075248 | A1 * | 6/2002 | Morita | G09G 3/3677 | 345/204 |
| 2003/0146890 | A1 * | 8/2003 | Sasaki | G09G 3/3659 | 345/87 |
| 2006/0164380 | A1 * | 7/2006 | Yang | G09G 3/3677 | 345/103 |
| 2012/0268423 | A1 * | 10/2012 | Hotelling | G06F 3/04184 | 345/173 |
| 2013/0176318 | A1 * | 7/2013 | Dunn | G09G 3/3413 | 345/92 |
| 2015/0187804 | A1 * | 7/2015 | Park | H01L 27/124 | 257/43 |
| 2015/0356925 | A1 * | 12/2015 | Lee | G09G 3/3266 | 345/212 |
| 2016/0196795 | A1 * | 7/2016 | Kim | G09G 3/3696 | 345/211 |
| 2016/0225338 | A1 * | 8/2016 | Lee | G09G 3/3275 | |
| 2017/0004763 | A1 * | 1/2017 | Mosier | G09G 3/20 | |

FOREIGN PATENT DOCUMENTS

| | | | | |
|---|---|---|---|---|
| EP | 2739121 | | 6/2014 | |
| EP | 3539121 | | 9/2019 | |
| IL | 248845 | A * | 3/2018 | G02F 1/1368 |
| JP | S5677887 | | 6/1981 | |
| JP | S6047298 | A | 3/1985 | |
| JP | 2010020023 | | 1/2010 | |

OTHER PUBLICATIONS

Notification of Transmittal of the International Search Report and the Written Opinion of the International Searching Authority, or the Declaration dated Oct. 16, 2018, by the European Patent Office for related international application PCT/US2018/017873.

Notice on the First (Chinese) Office Action dated Jan. 5, 2021 issued on related Chinese patent application 201880011380.5 by the China National Intellectual Property Administration.

Israel Office Action dated Jun. 22, 2021 (Jun. 22, 2021) issued on related Israeli patent application 268192 by the State of Israel—Ministry of Justice—The Patent Authority.

Communication pursuant to Article 94(3) EPC dated Nov. 23, 2021 (Nov. 23, 2021) issued by the European Patent Office on related patent application 18707516.3.

* cited by examiner

FAULT-TOLERANT LCD DISPLAY WITH DUAL TRANSISTOR PIXEL CELLS

CROSS REFERENCE TO RELATED APPLICATIONS

This application claims full benefit of and priority to U.S. provisional patent application No. 62/457,401 filed Feb. 10,2017 titled, "FAULT-TOLERANT LCD DISPLAY WITH DUAL PIXEL TRANSISTORS," the disclosure of which is fully incorporated herein by reference for all purposes.

FIELD AND BACKGROUND OF THE INVENTION

Field of the Invention

The present invention relates to systems and methods for fault-tolerant electronic displays. More particularly, embodiments of the present invention provide for an LCD panel having multiple TFT switching transistors within each pixel cell, each switching transistor respectively supplied with separate source and gate drivers.

Background of the Invention

Fault-tolerant Active Matrix Liquid Crystal Displays (AMLCDs) are useful for flight-critical, primary aircraft cockpit displays where safety and high reliability are of the utmost importance for both military and commercial aircraft platforms. However, the desired fault tolerance presents significant challenges.

U.S. Pat. Nos. 7,295,179 and 7,728,788 both present possible approaches to fault tolerance through simple redundancy. U.S. Pat. No. 7,295,179 describes a liquid crystal display with two identical but totally electrically isolated left and right side displays residing on one single glass substrate. Under this arrangement, if a fault occurs in one side of the composite display (in one of the displays), the other side will still be operational. Thus, in this arrangement, the two displays can be driven to appear as one display and if one of the displays fails, the failing display is simply turned off and the other display continues (but with now only half of the total display area of the two displays working together). So in essence, a fault in the left or right (or top or bottom) portion of the composite display can be isolated to the left or the right (or top or bottom) portion and does not render the entire display unusable.

The approach put forward in U.S. Pat. No. 7,728,788 partitions the liquid crystal display into multiple sections which are driven by independent sources. Fault tolerance is achieved somewhat in that if one section fails, the remaining section(s) can remain operational.

The approach put forward in Republic of Korea patent 10-1999-0052420 adds data lines for the purpose of improving manufacturing yield and allows dual gate drive which helps overcome internal propagation delay times in the long axis of the display.

Unfortunately, if a fault occurs in the above solutions, typically there is some amount of the original (display) information lost, but the display system might yet still display enough information for the flight crew to return home safely.

SUMMARY OF THE INVENTION

The following technical disclosure is exemplary and explanatory only and is not necessarily restrictive of the invention as claimed.

There is provided in one embodiment, a fault-tolerant LCD display system. The system includes an LCD panel having first and second TFT switching transistors within each pixel cell, such that each pixel cell has a first TFT transistor and a second TFT transistor; a first driver couplet including a first gate driver and a first source driver for operating the first TFT transistors of the pixel cells; and a second driver couplet including a second gate driver and a second source driver for operating the second TFT transistors of the pixel cells. In various embodiments, the first gate driver and the second gate driver feed into the LCD panel from opposite directions, and the first source driver and the second source driver feed into the LCD panel from opposite directions. Further, the first driver couplet and the second driver couplet may each respectively include a respective and separate power supply.

The LCD panel may comprise any desired type suitable to the embodiments of the present invention. In various embodiments, the LCD panel may comprise a thin film transistor display, and the LCD panel may further include a plurality of pixel cells, each of the pixel cells including two (or more) separately controllable switching transistors. The LCD panel may further be configured with first and second edges opposite each other and third and fourth edges opposite each other, and wherein the first and second gate drivers feed the LCD panel through the first and second opposite edges and the first and second source drivers feed the LCD panel through the third and fourth opposite edges.

The allowance for separate and redundant driver pairs provided for enhanced reliability and fault tolerance in various aspects. For example, there is also provided, in an embodiment of the present invention, a fault-tolerant LCD display system comprising an LCD panel; a first driver pair including a first gate driver and a first source driver; a second driver pair including a second gate driver and a second source driver; and wherein individual pixels of the LCD panel are driven simultaneously by the driver pairs, such that if one of the driver pairs experiences a fault, the other driver pair continues to drive the LCD panel without loss of information despite the fault within the one driver pair. In one optional embodiment, the first driver pair and the second driver pair each respectively include independent and separate power supplies. In yet another embodiment, the LCD panel may comprise a thin film transistor display, and optionally, the LCD panel may comprises a plurality of pixel cells, each of the pixel cells including two separately controllable switching transistors. In such embodiments, the LCD display may be configured with first and second edges opposite each other and third and fourth edges opposite each other, and wherein the first and second gate drivers feed the LCD panel through the first and second opposite edges and the first and second source drivers feed the LCD panel through the third and fourth opposite edges.

There is also provided embodiments providing a fault-tolerant LCD display system that includes an LCD panel; at least one gate driver; and at least two source drivers, the at least two separate source drivers coupled to separate switching transistors included in at least one pixel cell of the LCD panel. Further, aspects include two independent and separate power supplies respectively coupled to for the source drivers, and further, the LCD panel may comprise a thin film transistor display. In addition, the LCD panel comprises a plurality of pixel cells, each of the pixel cells including two separately controllable switching transistors.

In one example form, the present invention relates to a fault-tolerant AMLCD display system having a first driver couplet including a first gate driver and a first source driver, and a second driver couplet including a second gate driver and a second source driver. The first gate driver and the second gate driver feed into the AMLCD panel from opposite directions and the first source driver and the second source driver feed into the AMLCD panel from opposite directions. The pixels of the AMLCD panel are driven simultaneously by two pairs of source drivers and gate drivers, such that if one of the driver pairs fails due to some fault, the other driver pair can continue to drive the AMLCD panel without loss of information despite the failure of the one driver pair.

Preferably, the primary source and gate drivers are operative to drive the display with first TFT transistors, while the secondary source and gate drivers are operative to drive the display with second TFT transistors. Thus, the display incorporates an additional TFT within the pixel cell which is driven independently, thereby increasing the reliability even at the pixel level. This enhances fault tolerance by adding an additional switching transistor within each pixel cell. This novel approach allows for a full screen presentation even if a fault occurs, thereby allowing the display to continue to operate with no loss of information. By contrast, if a fault occurs in a prior art display, typically a portion of the original information will be lost.

Optionally, the first driver couplet and the second driver couplet each have their own independent power supplies, independent from one another. Preferably, individual sub-pixels of the AMLCD panel are driven simultaneously by two pairs of source drivers and gate drivers, such that if one of the driver pairs fails due to some fault, the other driver pair can continue to drive the AMLCD panel without loss of information despite the failure of the one driver pair.

In another example form, the present invention relates to a fault-tolerant AMLCD display system comprising an AMLCD panel, a first driver pair including a first gate driver and a first source driver, and a second driver pair including a second gate driver and a second source driver. In this arrangement, individual pixels or sub-pixels of the AMLCD panel are driven simultaneously by the driver pairs, such that if one of the driver pairs fails due to some fault, the other driver pair can continue to drive the AMLCD panel without loss of information despite the failure of the one driver pair.

Preferably, the first gate driver and the second gate driver feed into the AMLCD panel from opposite directions and the first source driver and the second source driver feed into the AMLCD panel from opposite directions. Optionally, the AMLCD display panel has four edges and the gate drivers and the source drivers are fed into the AMLCD display panel along the four edges.

Preferably, the display panel comprises a thin film transistor (TFT) display.

In another example form the present invention preferably comprises a fault-tolerant AMLCD display system including an AMLCD panel, at least one gate driver, and at least two source drivers.

Described another way, the present invention includes a fault-tolerant display system includes a dual-transistor TFT panel, a first driver couplet including a first gate driver and a first source driver, and a second driver couplet including a second gate driver and a second source driver. The first gate driver and the second gate driver feed into the LCD panel from opposite directions and the first source driver and the second source driver feed into the LCD panel from opposite directions. The primary source and gate drivers are operative to drive the display with first TFT transistors, while the secondary source and gate drivers are operative to drive the display with second TFT transistors. Thus, the display incorporates an additional TFT within the pixel cell which is driven independently, thereby increasing the reliability even at the pixel level. In this way, individual pixels of the LCD panel are driven simultaneously by two pairs of source drivers and gate drivers, such that if one of the driver pairs fails due to some fault, the other driver pair can continue to drive the LCD panel without loss of information despite the failure of the one driver pair.

Advantageously, the present invention provides improved, superior redundancy, by driving the pixels and/or sub-pixels redundantly. This pixel-level redundancy allows for full screen operation even with individual faults. Thus, a single-point of failure condition is avoided and the display panel (be it an AMLCD or other TFT-based display) can still provide all of the original information presented prior to the occurrence of the fault.

BRIEF DESCRIPTION OF THE DRAWINGS

A more complete understanding of the present invention may be derived by referring to the detailed description and claims when considered in connection with the following illustrative figures.

DETAILED DESCRIPTION OF THE PREFERRED EMBODIMENTS

Figure 1:
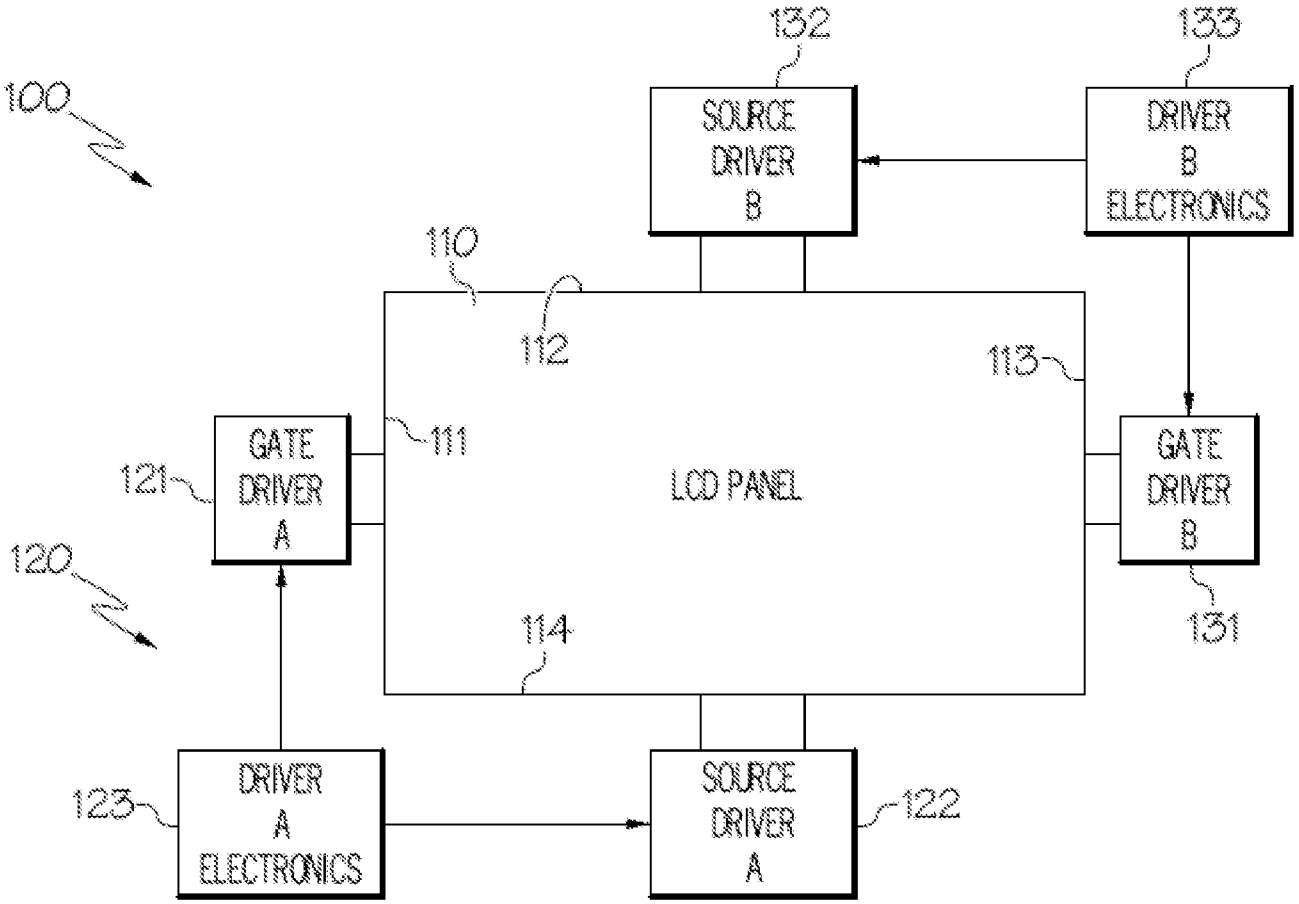
FIG. 1 is a schematic illustration of a fault-tolerant display system according to a preferred example form of the present invention, showing an AMLCD display panel having its pixels driven concurrently by two separate driver sets.

Referring now in detail to the drawing figures, where like reference numerals represent like parts throughout the several views, FIG. 1 shows a fault-tolerant display system 100 according to a preferred example form of the present invention, showing an AMLCD display panel 110 having its pixels driven concurrently by two separate driver sets 120, 130. Preferably, the display panel 110 comprises a TFT display (thin film transistor). Although an AMLCD panel is shown, the fault-tolerant display system can also be another other type of display, such as OLED, electrophoretic, QLED, micro-LED, etc.).

The first driver set 120, designated on the figure as the "A" driver set, includes a Gate Driver A designated at 121, a Source Driver A designated at 122, and associated A driver electronics designated at 123. Likewise, the second driver set 130, designated on the figure as the "B" driver set, includes a Gate Driver B designated at 131, a Source Driver B designated at 132, and associated B driver electronics designated at 133.

The first (A) gate driver 121 and the second (B) gate driver 131 feed into the AMLCD panel 110 from opposite directions and the first (A) source driver 122 and the second (B) source driver feed 132 into the AMLCD panel 110 from opposite directions. In particular, the AMLCD panel 110 optionally has four edges 111, 112, 113, and 114. The gate drivers 121, 131 are respectively fed into the AMLCD display panel 110 along edges 111, 113. Likewise, the source drivers 122, 132 are respectively fed into the AMLCD display panel 110 along the edges 114, 112.

Figure 2:
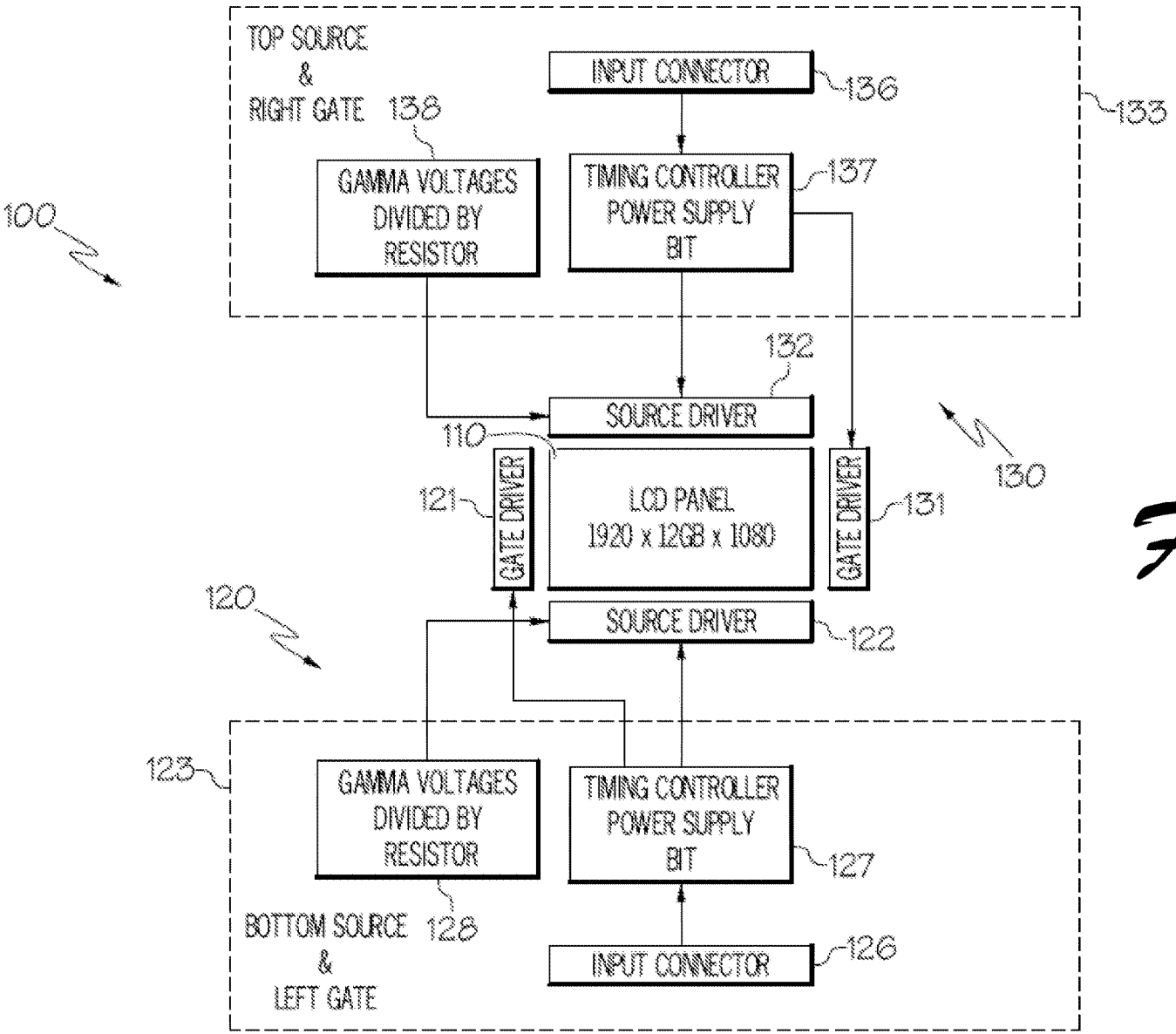
FIG. 2 is a more detailed schematic illustration of the fault-tolerant display system of FIG. 1.

As shown in FIG. 2, in an optional form the display panel 110 can be a TFT display having a typical horizontal resolution of 1920 each red, green, and blue subpixels in each line and a typical vertical resolution of 1080 lines (1920×12GB×1080). Also, the A driver electronics 123 can include an input connector 126, the timing controller, power supply, and built in test (BIT) functions 127, and the gamma voltage divider function 128. The input connector 126 electrically couples the digital video input signal (LVDS, DisplayPort, MIPI, etc.) to the timing controller and power supply 127. In turn, timing controller power supply 127 is coupled to the A gate driver 121 and to the A source driver 122. The gamma voltage divider function 128 is connected to the A source driver 122.

Similarly, the B driver electronics 133 can include an input connector 136, the timing controller, power supply, and built in test (BIT) functions 137, and a gamma voltage divider function 138. The input connector 136 electrically couples the digital video input signal (LVDS, DisplayPort, MIPI, etc.) to the timing controller and power supply 137. In turn, the timing controller power supply 137 is coupled to the B gate driver 131 and to the B source driver 132. The gamma voltage divider function 138 is connected to the B source driver 132.

Inasmuch as the two driver pairs 120, 130 each have their own independent power supply (see 127, 137), they each have their own $V_{com}$.

Figure 3:
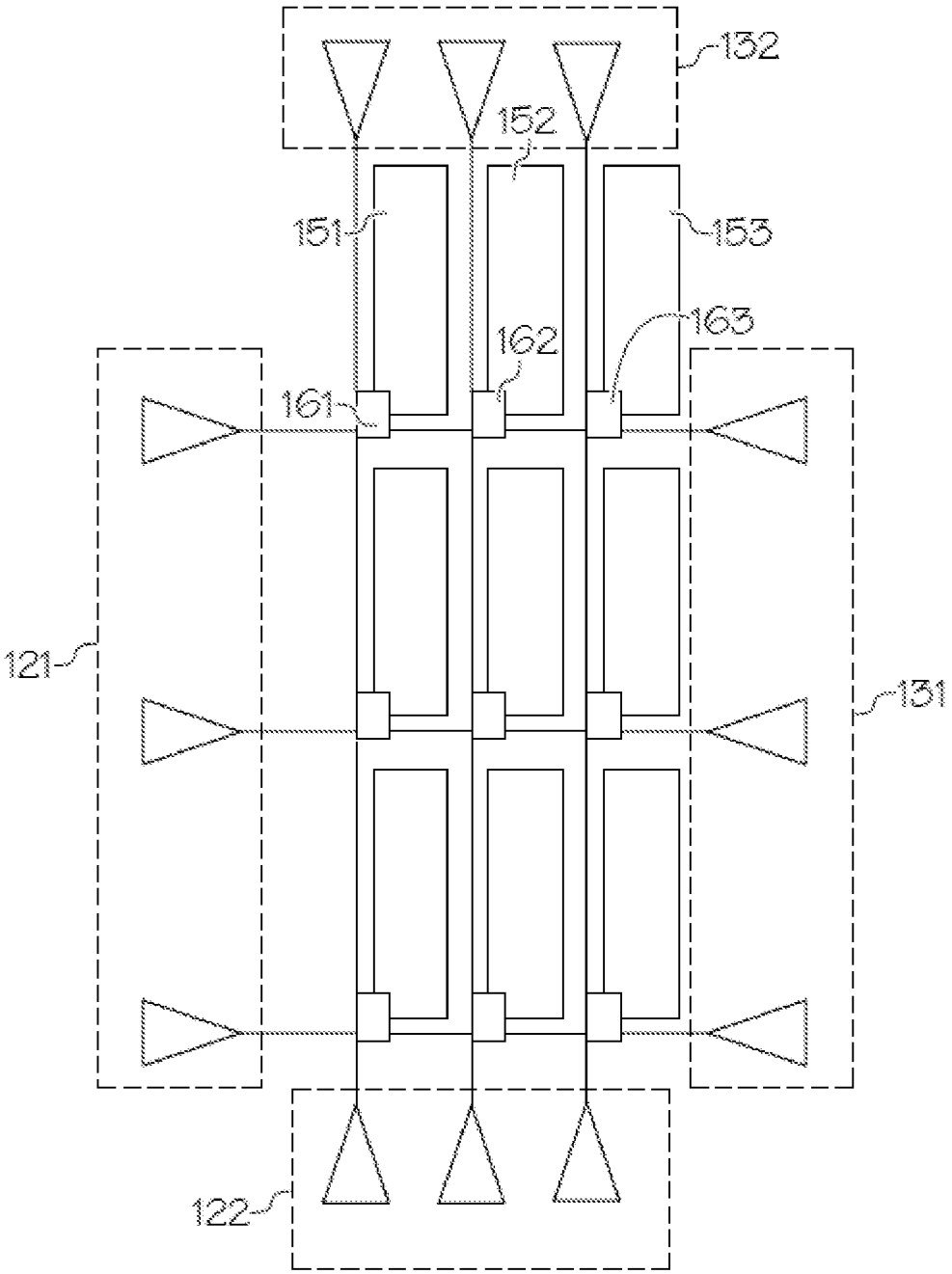
FIG. 3 is a detailed schematic illustration of the fault-tolerant display system of FIG. 1, showing how, on a pixel level (or sub-pixel level), the pixels of the AMLCD display are driven by separate driver sets.

Advantageously, the present invention provides improved, superior redundancy, by driving the pixels through independent redundant switching transistors and driving paths. This pixel-level redundancy allows for full screen operation even with individual faults. Thus, a single-point of failure condition is avoided and the display panel (be it an AMLCD or any TFT-based display) can still provide all of the original information presented prior to the occurrence of the fault. In the context of an RGB display panel, the pixel-level redundancy can be viewed as a sub-pixel level redundancy. Indeed, as shown in FIG. 3, the red-green-blue sub-pixels, such as sub-pixels 151, 152, 153 are each switched by their corresponding transistors 161, 162, 163. The transistors are operated by the drivers. As seen in this illustration, each of the transistors 161, 162, 163 is redundantly driven by two gate drivers (121, 131). Also, each transistor is redundantly driven by two source drivers (122, 132). Thus, if one of the gate drivers fails, the other is sufficient to continue to drive the transistor. Likewise, if one of the source drivers fails, the other is likewise sufficient to drive the transistor. Thus, despite the fact that a fault might be detected in a gate driver or a source driver, the panel can be operated as normal. If a fault is detected in a gate driver, preferably one would turn off the fault-laden gate driver and operate with only the other, non-faulty gate driver. Likewise, if a fault is detected in a source driver, preferably one would turn off the fault-laden source driver and operate with only the other, non-faulty source driver.

Figure 4:
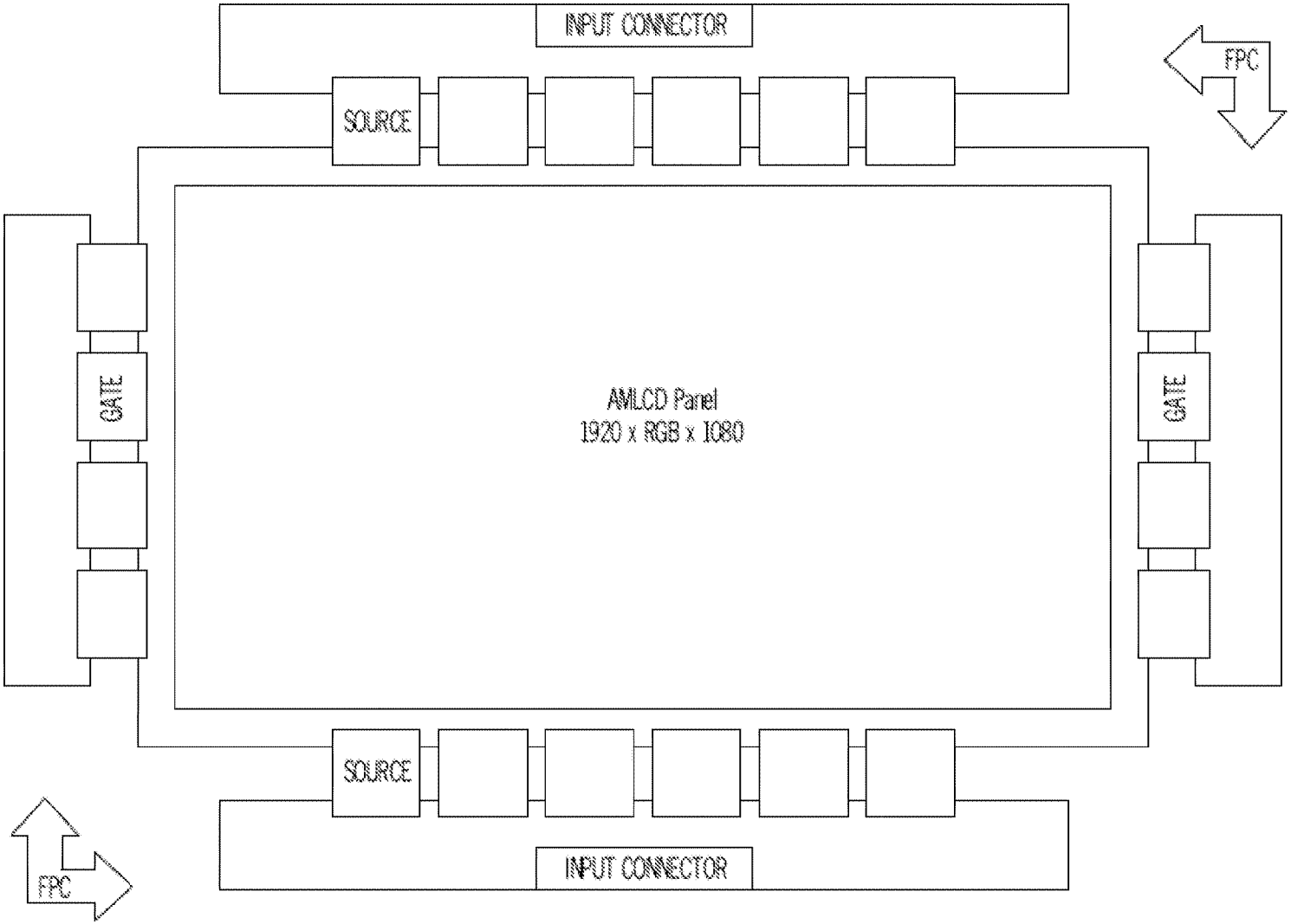
FIG. 4 is a schematic illustration of a fault-tolerant display system according to another preferred example form of the present invention, showing a typical implementation of the physical layout of the fault tolerant AMLCD display panel.

FIG. 4 shows a typical example of the physical layout of the fault tolerant display which illustrates the two driver sets (each consisting of driver electronics, source drivers and gate drivers connected together via a flex printed circuit (FPC)) located external to the AMLCD panel. Alternate configurations of this invention may incorporate either some or all of the components of the two driver sets (driver electronics, source drivers, gate drivers, etc.) located directly on the AMLCD or other TFT-based display panel. Advantageously, these arrangements provide both maximum availability of the display and maximum integrity of the data/images displayed thereon. In aircraft applications, this can be critically important.

Figure 5:
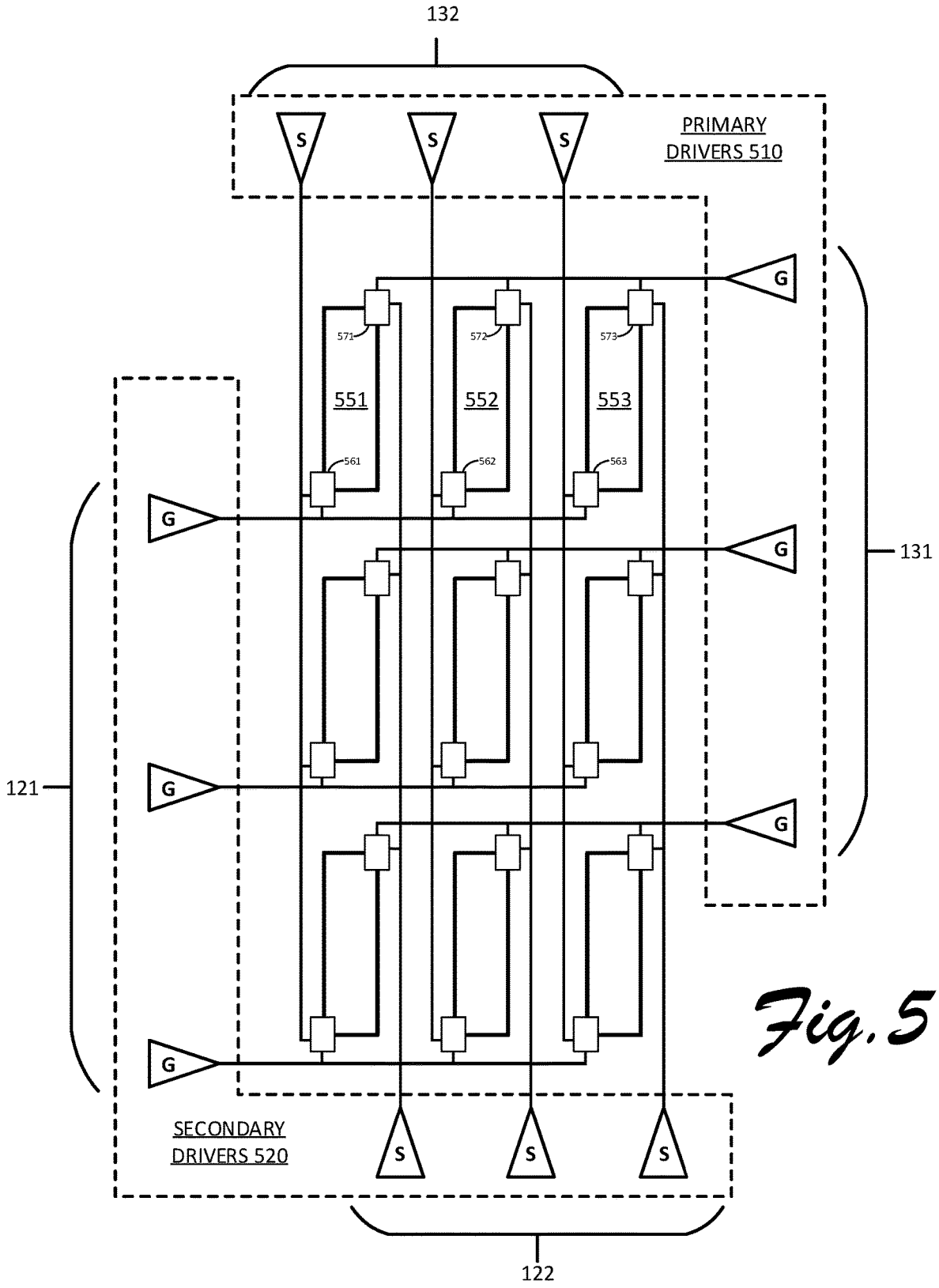
FIG. 5 is a schematic illustration of a fault-tolerant display system according to preferred example form of the present invention, showing a dual-transistor display panel in which each pixel cell has first and second TFT transistors.
Figure 5A:
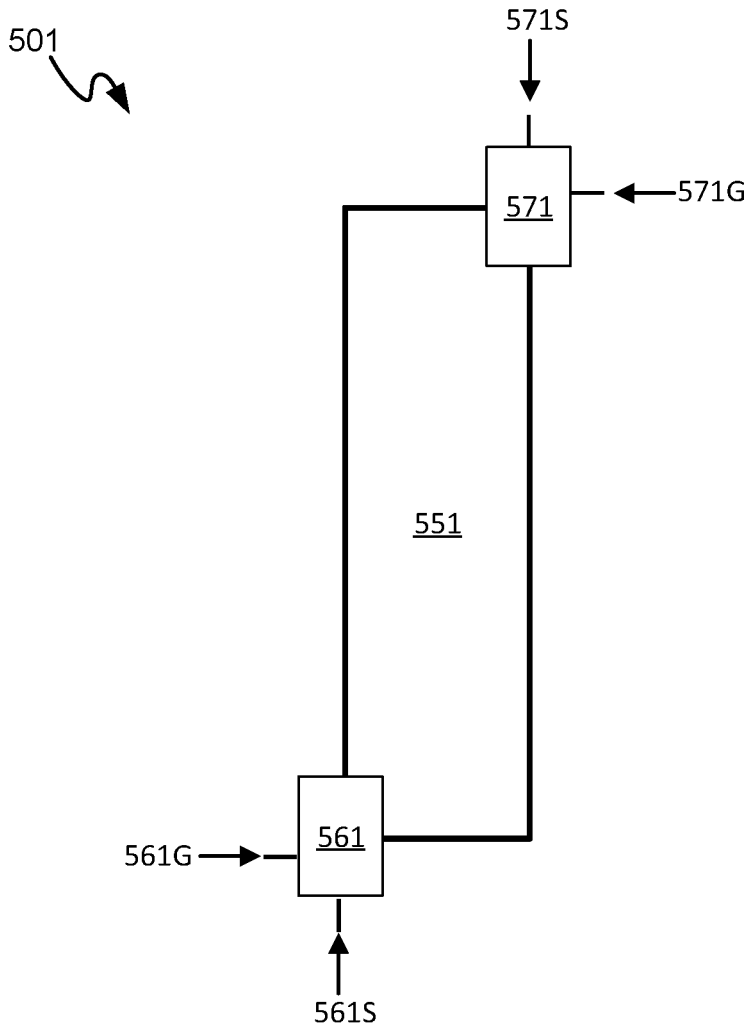
FIG. 5A illustrates a schematic illustration of a sub-pixel according to preferred example form of the present invention, showing a two transistors that may independently drive the sub-pixel.

FIG. 5 depicts a schematic illustration 501 of a sub-pixel 551 according to preferred example form of the present invention, showing two transistors 561, 571 that are configured to independently switch the sub-pixel 551; in a preferred embodiment, the transistors comprise TFT (thin-film transistor) devices. The transistors 561, 571 are operated by driver inputs. More particularly, each of the transistors 561, 571 are respectively driven by gate drivers 561G, 571G; likewise, each of the transistors 561, 571 are respectively driven by source drivers 561S, 571S. Sub-pixel 551 may be switched to an on state by either of the transistors 561, 571; as such, if any faults occur in the source driver or gate driver for either transistor 561, 571, or if a fault occurs in the either of the transistors 561, 571 for that matter, the other transistor with which no failure mode was associated may be used to switch the sub-pixel 551. In a preferred embodiment, gate drivers 561G and 571G are provided by independent gate driver sources, and source drivers 561G, 571G are provided by independent gate driver sources. Although transistors 561, 571 are shown respectively at lower left and upper right sides of the sub-pixel 551, any desired location or configuration may be used provided that the transistors 561, 571 may independently switch sub-pixel 551. Additionally, while a dual switching transistor configuration is shown, those of skill in the art appreciate that three or more switching transistors may be communicatively coupled to the sub-pixel 551 to provide additional levels of redundancy and fault tolerance; in various embodiments each of the switching transistors coupled to the sub-pixel may receive source and gate drive signals from drivers independent from those coupled to the other transistors that are used to switch the sub-pixel 551.

Turning to FIG. 5, a schematic representation of the present invention depicts a portion of dual-transistor display panel with fault-tolerant features. The schematic includes a subset of a matrix of sub-pixels interconnected to source and gate drivers (although 9 of such subpixels are shown, in practice there are thousands of such sub-pixels implemented within a display unit).

In one embodiments, a set of primary drivers 510 are used to drive a set of primary switching transistors 571, 572, 573, where the primary source 132 and gate 131 drivers are operative to drive the sub-pixels 551, 552, 553 of the display with TFT transistors 571, 572, 573, while the secondary source 122 and gate 121 drivers are operative to independently drive the same sub-pixels 551, 552, 553 with second TFT transistors 561, 562, 563. Thus, the display incorporates an additional TFT configuration within each pixel cell that are driven independently, thereby increasing the reliability even at the pixel level. In one exemplary embodiment, primary drivers 510 are used to drive pixels within the display, and if a fault condition is detected (such as in either in a primary source driver 132, a primary gate driver 131, or a primary power supply), secondary drivers 520 may be utilized to switch transistors 561, 562, 563, allowing sub-pixels 551, 552, 553 to continue operation even when a fault mode is associated with the primary drivers 510 or primary transistors 571, 572, 573. This novel approach allows for a full screen presentation even if a fault occurs, thereby allowing the display to continue to operate with no loss of information. By contrast, if a fault occurs in a prior art display, typically a portion of the original information will be lost.

Figure 6:
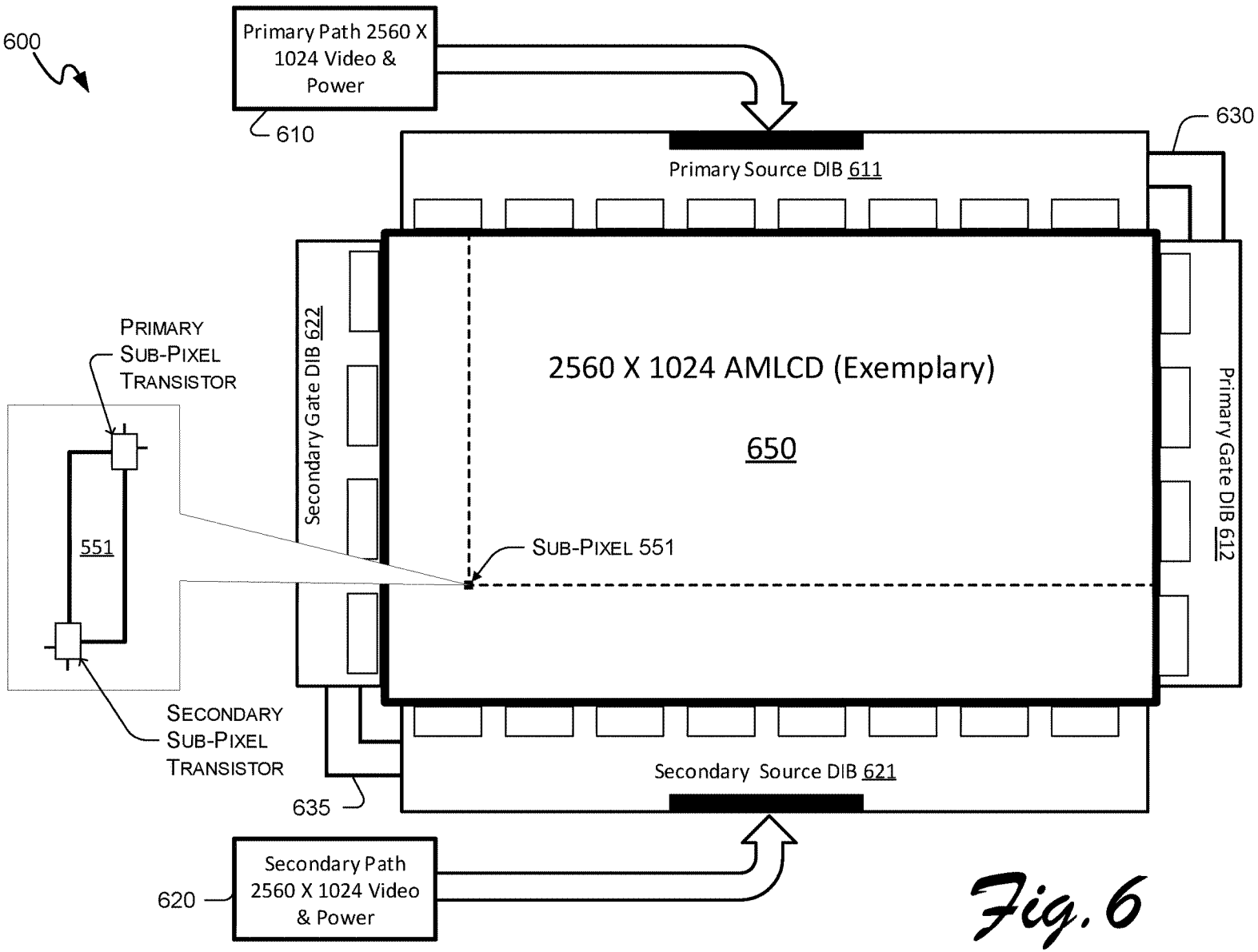
FIG. 6 is another schematic illustration of the fault-tolerant display system of FIG. 5.

FIG. 6 illustrates a the fault-tolerant display system of FIG. 5 implemented in a display (such as an exemplary 2560×1024 AMLCD display communicatively coupled to a display interface board (DIB)). A primary data path 610 provides video data and power to the primary source DIB 611 which is also coupled 630 to a primary gate DIB 612. Each of the primary source DIB 611, and gate DIB 612 provides respective drivers 132, 131 as shown in FIG. 5. Such drivers are coupled into the AMLCD display 650 in a manner consistent with the schematic shown in FIG. 5, and in particular, any subpixel of the display (such as that shown at 551) comprises a primary switching transistor (e.g. 571, 572, 573) coupled to the primary source DIB 611 and gate DIB 612, and a secondary switching transistor (e.g. 561, 562, 563) coupled to the secondary source DIB 621 and gate DIB 622. Accordingly, the secondary data path 620 provides video data and power to the secondary source DIB 621 which is also coupled 635 to a secondary gate DIB 622. In one embodiment, the primary data path 610 provides video and power for normal operation, and if a fault is detected in any aspect associated with the primary source 132 or gate drivers 131, the secondary path 620 may be utilized to provide video information to the display 650 through secondary source drivers 122 and gate drivers 121 that are respectively coupled to the secondary source DIB 621 and gate DIB 622.

It is to be understood that this invention is not limited to the specific devices, methods, conditions, or parameters described and/or shown herein, and that the terminology used herein is for the purpose of describing particular embodiments by way of example only. Indeed, these examples are not intended to be all-inclusive of the possible implementations of this invention. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims. The particular implementations shown and described above are illustrative of the invention and its best mode and are not intended to otherwise limit the scope of the present invention in any way. Indeed, for the sake of brevity, conventional data storage, data transmission, and other functional aspects of the systems may not be described in detail. Methods illustrated in the various figures may include more, fewer, or other steps. Additionally, steps may be performed in any suitable order without departing from the scope of the invention. Furthermore, the connecting lines shown in the various figures are intended to represent exemplary functional relationships and/or physical couplings between the various elements. Many alternative or additional functional relationships or physical connections may be present in a practical system.

Changes and modifications may be made to the disclosed embodiments without departing from the scope of the present invention. These and other changes or modifications are intended to be included within the scope of the present invention, as expressed in the following claims.

What is claimed is:

1. A method of driving a liquid crystal display (LCD) system comprising a fault-tolerant LCD panel comprising a plurality of sub-pixels, the method comprising:

simultaneously driving each of the plurality of sub-pixels via two or more of:

a first driver circuit comprising a first thin film transistor (TFT) connected to a first driver couplet comprising a first gate driver and a first source driver operably connected to the first TFT of each of the plurality of sub-pixels, a second driver circuit comprising a second TFT, operably separate from the first TFT, and connected to a second driver couplet comprising a second gate driver, and a second source driver operably connected to the second TFT of each of the plurality of sub-pixels, and a third driver circuit comprising a third TFT, operably separate from each of the first TFT and the second TFT and connected to a third driver couplet comprising a third gate driver and a third source driver operably connected to the third TFT of each of the plurality of sub-pixels;

determining a fault with respect to one of the first driver circuit, the second driver circuit, and the third driver circuit;

continuing to drive each of the plurality of sub-pixels via at least one of the first driver circuit, the second driver circuit, and the third driver circuit in which no fault has been determined;

wherein the first gate driver and the second gate driver feed into the fault-tolerant LCD panel from opposite directions and wherein the first source driver and the second source driver feed into the fault-tolerant LCD panel from opposite directions.

2. The method of claim 1, wherein the LCD system further comprises comprising a first power supply operably coupled to the first driver couplet; a second power supply, separate from the first power supply, operably coupled to the second driver couplet; and a third power supply, separate from the first power supply and the second power supply, operably coupled to the third driver couplet.

3. The method of claim 1, wherein the fault-tolerant LCD panel comprises a thin film transistor display.

4. The method of claim 1, wherein the fault-tolerant LCD panel comprises a first edge and a second edge opposite the first edge, and a third edge and a fourth edge opposite the third edge;

wherein the first gate driver and the second gate drivers feed into the fault-tolerant LCD panel through the first edge and the second edge, respectively; and wherein the first source driver and the second source driver feed into the fault-tolerant LCD panel through the third edge and fourth edge, respectively.

* * * * *